US011694503B2

(12) United States Patent
Patel et al.

(10) Patent No.: US 11,694,503 B2
(45) **Date of Patent: *Jul. 4, 2023**

(54) ARTICULATING HINGE ASSEMBLY FOR SECURING AN ACCESS DOOR ON A GAMING MACHINE CABINET

(71) Applicant: Aristocrat Technologies Australia Pty Limited, North Ryde (AU)

(72) Inventors: Jigarkumar Ghanshyambhai Patel, Las Vegas, NV (US); Timothy Francis Barbour, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/529,092

(22) Filed: Nov. 17, 2021

(65) Prior Publication Data

US 2022/0076526 A1 Mar. 10, 2022

Related U.S. Application Data

(63) Continuation of application No. 16/845,947, filed on Apr. 10, 2020, now Pat. No. 11,195,368, which is a (Continued)

(51) Int. Cl.
*G07F 17/32* (2006.01)
*E05D 7/04* (2006.01)

(Continued)

(52) U.S. Cl.
CPC ..... *G07F 17/3216* (2013.01); *E05D 3/16* (2013.01); *E05D 5/06* (2013.01); *E05D 7/0407* (2013.01);

(Continued)

(58) Field of Classification Search
CPC ..... G07F 17/3216; G07F 9/06; E05D 7/0407
See application file for complete search history.

(56) References Cited

U.S. PATENT DOCUMENTS 1,293,695 A 2/1919 Burrows
4,290,167 A * 9/1981 Lautenschlager ..... E05D 5/0276 248/668

(Continued)

FOREIGN PATENT DOCUMENTS

EP 1736627 A2 12/2006
JP H0427089 A 1/1992

OTHER PUBLICATIONS

AU Examination Report for AU Application No. 2018204801, dated Mar. 19, 2019, 8 pages.

(Continued)

*Primary Examiner* — Chase E Leichliter
(74) *Attorney, Agent, or Firm* — Armstrong Teasdale LLP

(57) ABSTRACT

A hinge assembly for securing a door on a gaming machine cabinet includes a first flange coupled to the door, a second flange coupled to the cabinet, a first link pair coupled to and extending from the first flange at a first pivot joint, a second link pair coupled to and extending from the first flange at a second pivot joint, a third link pair coupled to the first link pair at a third pivot joint, wherein the third link pair is further coupled to the second flange at a fourth pivot joint, and wherein the third link pair is further coupled to the second link pair at a fifth pivot joint, and a fourth link pair coupled to the second flange at a sixth pivot joint, wherein the fourth link pair is further coupled to the second link pair at a seventh pivot joint.

20 Claims, 9 Drawing Sheets

Related U.S. Application Data continuation of application No. 15/927,246, filed on Mar. 21, 2018, now Pat. No. 10,643,422.

(60) Provisional application No. 62/564,381, filed on Sep. 28, 2017.

(51) Int. Cl.
*G07F 9/06* (2006.01)
*E05D 5/06* (2006.01)
*E05D 3/16* (2006.01)

(52) U.S. Cl.
CPC ..... *G07F 9/06* (2013.01); *E05Y 2900/208* (2013.01); *E05Y 2900/608* (2013.01)

(56) References Cited

U.S. PATENT DOCUMENTS 4,881,744 A 11/1989 Hansen
5,035,026 A * 7/1991 Carlo ..... E05D 3/16 16/302
5,251,738 A 10/1993 Dabrowski
5,465,463 A * 11/1995 Lautenschlager ..... E05D 15/264 16/236
5,511,287 A * 4/1996 Lautenschlager ..... E05D 7/0407 16/236
5,515,959 A * 5/1996 Stephenson, III .. G07F 17/3216 194/350
5,544,595 A * 8/1996 Stephenson, III .. E05D 11/0018 16/374
5,740,897 A 4/1998 Gauselmann
6,032,333 A * 3/2000 Brustle ..... E05D 7/0407 16/245
6,409,589 B1 * 6/2002 Laconico, Jr. ..... G07F 9/06 194/350
6,918,160 B1 * 7/2005 Clark ..... B63B 29/06 16/370
8,388,454 B2 * 3/2013 Kido ..... G07F 17/32 463/46
8,419,550 B2 4/2013 Anthony
9,169,679 B2 10/2015 McAdoo
10,643,422 B2 * 5/2020 Patel ..... E05D 3/16
11,195,368 B2 * 12/2021 Patel ..... E05D 7/0407
2004/0132528 A1 * 7/2004 Gauselmann ..... G07F 17/32 463/29
2006/0156513 A1 * 7/2006 Zetti ..... E05F 1/1253 16/288
2008/0017473 A1 1/2008 Nunn
2011/0072617 A1 * 3/2011 Lin ..... E05F 5/006 16/298
2011/0111866 A1 * 5/2011 Anthony ..... G07F 17/32 463/46
2015/0218863 A1 * 8/2015 Cooper ..... E05D 7/0415 16/235
2015/0325074 A1 11/2015 Sprenger
2017/0218671 A1 * 8/2017 Frank ..... E05D 7/06
2017/0218675 A1 * 8/2017 Cooper ..... E05D 3/142
2017/0218871 A1 8/2017 Decia
2018/0081391 A1 * 3/2018 Mittler ..... G07F 17/3211
2018/0106088 A1 * 4/2018 Zetti ..... E05D 3/16
2018/0216379 A1 * 8/2018 Spoelstra ..... E05D 3/14
2019/0096171 A1 * 3/2019 Patel ..... E05D 5/06
2020/0242886 A1 * 7/2020 Patel ..... E05D 3/16
2022/0076526 A1 * 3/2022 Patel ..... G07F 9/06

OTHER PUBLICATIONS

Office Action dated Feb. 19, 2021 for U.S. Appl. No. 16/845,947 (pp. 1-8).
Australian Examination Report for App. No. AU2020202013, dated Mar. 31, 2021, 5 pages.
Office Action (Final Rejection) dated Jul. 22, 2021 for U.S. Appl. No. 16/845,947 (pp. 1-7).
Office Action (Notice of Allowance and Fees Due (PTOL-85)) dated Sep. 23, 2021 for U.S. Appl. No. 16/845,947 (pp. 1-8).

* cited by examiner

ARTICULATING HINGE ASSEMBLY FOR SECURING AN ACCESS DOOR ON A GAMING MACHINE CABINET

CROSS REFERENCE TO RELATED APPLICATIONS

This application is a continuation of and claims priority to U.S. patent application Ser. No. 16/845,947, filed Apr. 10, 2020, and entitled ARTICULATING HINGE ASSEMBLY FOR SECURING AN ACCESS DOOR ON A GAMING MACHINE CABINET, which is a continuation of and claims priority to U.S. patent application Ser. No. 15/927,246, filed Mar. 21, 2018 and entitled ARTICULATING HINGE ASSEMBLY FOR SECURING AN ACCESS DOOR ON A GAMING MACHINE CABINET, which claims priority to U.S. Provisional Patent Application No. 62/564,381, filed Sep. 28, 2017 and entitled ARTICULATING HINGE ASSEMBLY FOR SECURING AN ACCESS DOOR ON A GAMING MACHINE CABINET, the entire contents and disclosures of which are hereby incorporated by reference in their entireties.

TECHNICAL FIELD

The field of disclosure relates generally to electronic gaming, and more particularly to electronic gaming machines including articulating hinge assemblies for securing doors on gaming machine cabinets.

BACKGROUND

Electronic gaming machines (EGMs), or gaming devices, provide a variety of wagering games such as, for example, and without limitation, slot games, video poker games, video blackjack games, roulette games, video bingo games, keno games, and other types of games that are frequently offered at casinos and other locations. Play on EGMs typically involves a player establishing a credit balance by inserting or otherwise submitting money and placing a monetary wager (deducted from the credit balance) on one or more outcomes of an instance, or play, of a primary game, sometimes referred to as a base game. In many games, a player may qualify for secondary games or bonus rounds by attaining a certain winning combination or other triggering event in the base game. Secondary games provide an opportunity to win additional game instances, credits, awards, jackpots, progressives, etc. Awards form any winning outcomes are typically added back to the credit balance and can be provided to the player upon completion of a gaming session or when the player wants to "cash out."

Slot games are often displayed to the player in the form of various symbols arranged in a row-by-column grid, or "matrix." Specific matching combinations of symbols along predetermined paths, or paylines, drawn through the matrix indicate the outcome of the game. The display typically highlights winning combinations and outcomes for ready identification by the player. Matching combinations and their corresponding awards are usually shown in a "paytable" that is available to the player for reference. Often, the player may vary his/her wager to included differing numbers of paylines and/or the amount bet on each line. By varying the wager, the player may sometimes alter the frequency or number of winning combinations, the frequency or number of secondary games, and/or the amount awarded.

Typical games use a random number generator (RNG) to randomly determine the outcome of each game. The game is designed to return a certain percentage of the amount wagered back to the player, referred to as return to player (RTP), over the course of many plays or instances of the game. The RTP and randomness of the RNG are fundamental to ensuring the fairness of the games and are therefore highly regulated. The RNG may be used to randomly determine the outcome of a game and symbols may then be selected that correspond to that outcome. Alternatively, the RNG may be used to randomly select the symbols whose resulting combinations determine the outcome. Notably, some games may include an element of skill on the part of the player and are therefore not entirely random.

BRIEF DESCRIPTION

In one aspect, an electronic gaming machine is provided. The electronic gaming machine includes a main cabinet securely enclosing a cash box. The electronic gaming machine also includes a door providing access to the cash box, and at least one hinge assembly securing the door to the main cabinet. The at least one hinge assembly includes a first flange coupled to the door, a second flange coupled to the cabinet, a first link pair coupled to and extending from the first flange at a first pivot joint, a second link pair coupled to and extending from the first flange at a second pivot joint, a third link pair coupled to the first link pair at a third pivot joint, wherein the third link pair is further coupled to the second flange at a fourth pivot joint, and wherein the third link pair is further coupled to the second link pair at a fifth pivot joint, and a fourth link pair coupled to the second flange at a sixth pivot joint, wherein the fourth link pair is further coupled to the second link pair at a seventh pivot joint.

In another aspect, a hinge assembly for securing a door on a gaming machine cabinet is provided. The hinge assembly includes a first flange coupled to the door, a second flange coupled to the cabinet, a first link pair coupled to and extending from the first flange at a first pivot joint, a second link pair coupled to and extending from the first flange at a second pivot joint, a third link pair coupled to the first link pair at a third pivot joint, wherein the third link pair is further coupled to the second flange at a fourth pivot joint, and wherein the third link pair is further coupled to the second link pair at a fifth pivot joint, and a fourth link pair coupled to the second flange at a sixth pivot joint, wherein the fourth link pair is further coupled to the second link pair at a seventh pivot joint.

In yet another aspect, a method of securing a door to a gaming machine cabinet is provided. The method includes mechanically coupling a first hinge assembly between an interior surface of the gaming machine cabinet and an interior surface of the door, and mechanically coupling a second hinge assembly between the interior surface of the gaming machine cabinet and the interior surface of the door, the second hinge assembly spaced apart from the first hinge assembly and extending substantially in parallel with the first hinge assembly.

BRIEF DESCRIPTION OF THE DRAWINGS

An example embodiment of the subject matter disclosed will now be described with reference to the accompanying drawings.

DETAILED DESCRIPTION

Embodiments of the gaming systems, gaming devices, and methods described herein provide a hinge assembly for use with a gaming device, such as an electronic gaming machine. Specifically, the hinge assembly couples an access door (also sometimes referred to as a "drop door") to a main cabinet of the electronic gaming machine, such that the access door opens out of the main cabinet and away from an external surface of the main cabinet. The hinge assembly includes a plurality of interdigitated members (or "link pairs" as described herein) coupled, one to another, by a plurality of fasteners, and articulates during operation, through a range of motion that is less than one-hundred-and-eighty degrees, such that the access door does not come into contact with the external surface of the main cabinet, thereby preventing damage or abrasion of the main cabinet by the access door.

Figure 1:
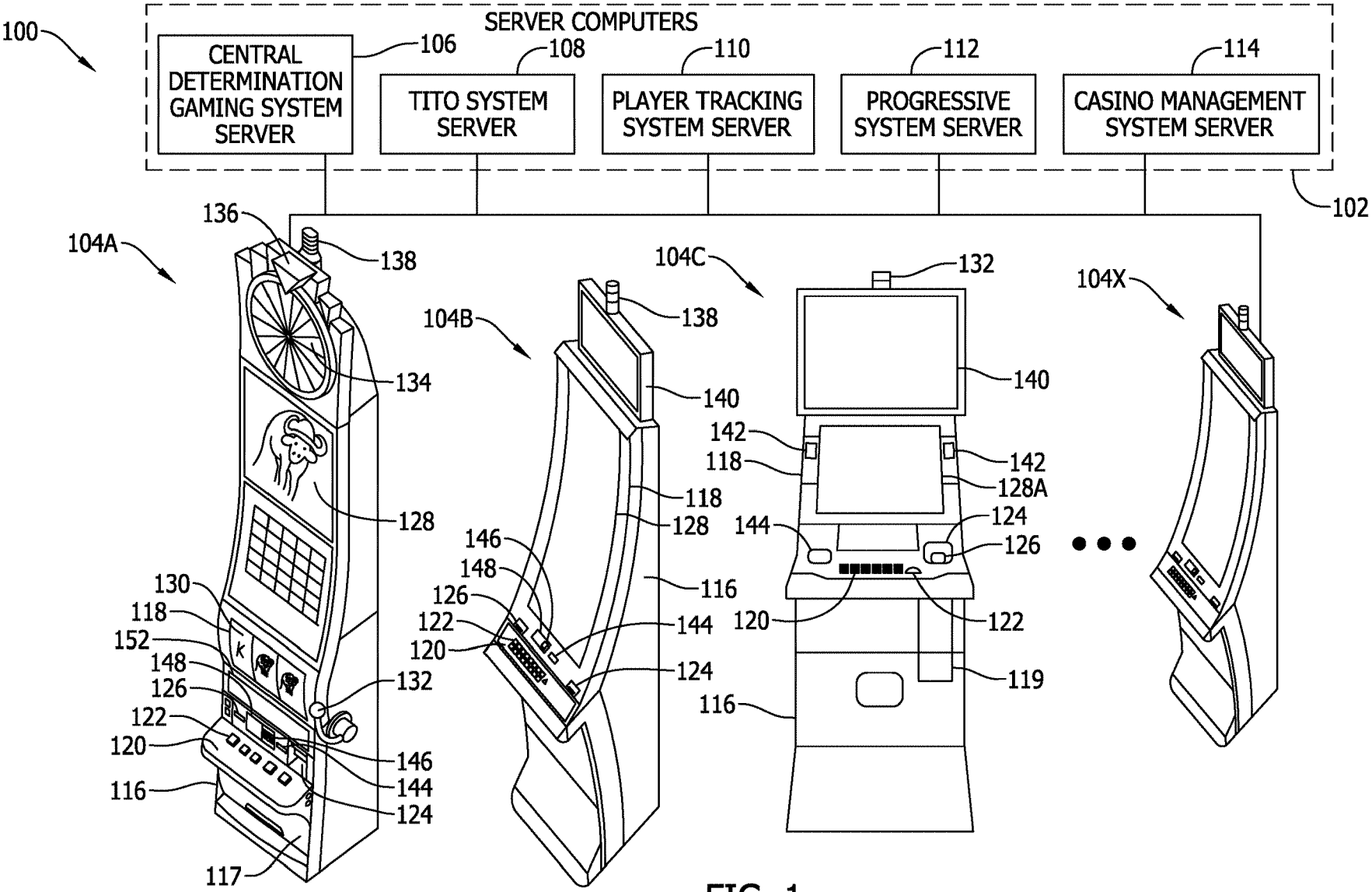
FIG. 1 is a diagram of exemplary EGMs networked with various gaming-related servers.

FIG. 1 is a diagram of exemplary EGMs networked with various gaming-related servers in a gaming system 100. Gaming system 100 operates in a gaming environment, including one or more servers, or server computers, such as slot servers of a casino, that are in communication, via a communications network, with one or more EGMs, or gaming devices 104A-104X, such as EGMs, slot machines, video poker machines, or bingo machines, for example. Gaming devices 104A-104X may, in the alternative, be portable and/or remote gaming devices such as, for example, and without limitation, a smart phone, a tablet, a laptop, or a game console.

Communication between gaming devices 104A-104X and servers 102, and among gaming devices 104A-104X, may be direct or indirect, such as over the Internet through a web site maintained by a computer on a remote server or over an online data network including commercial online service providers, Internet service providers, private networks, and the like. In other embodiments, gaming devices 104A-104X communicate with one another and/or servers 102 over wired or wireless RF or satellite connections and the like.

In certain embodiments, servers 102 may not be necessary and/or preferred. For example, the present invention may, in one or more embodiments, be practiced on a stand-alone gaming device such as gaming device 104A and/or gaming device 104A in communication with only one or more other gaming devices 104B-104X (i.e., without servers 102).

Servers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, a game outcome may be generated on a central determination gaming system server 106 and then transmitted over the network to any of a group of remote terminals or remote gaming devices 104A-104X that utilize the game outcome and display the result to the player.

Gaming device 104A is often of a cabinet construction that may be aligned in rows or banks of similar devices for placement and operation on a casino floor. The gaming device 104A often includes a main door 117 that provides access to the interior of a main cabinet 116. Gaming device 104A typically includes a button area or button deck 120 accessible by a player that is configured with input switches or buttons 122, a bill validator 124, and/or ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 including a plurality of mechanical reels 130, typically 3 or 5 mechanical reels, with various symbols displayed thereon. Reels 130 are then independently spun and stopped to show a set of symbols within the gaming display area 118 that may be used to determine an outcome to the game.

In many configurations, gaming device 104A may have a main display 128 (e.g., video display monitor) mounted to, or above, gaming display area 118. Main display 128 may be, for example, a high-resolution LCD, plasma, LED, or OLED panel that may be flat or curved as shown, a cathode ray tube, or other conventional electronically controlled video monitor.

In certain embodiments, bill validator 124 may also function as a "ticket-in" reader that enables the player to use a casino-issued credit ticket to load credits onto gaming device 104A (e.g., in a cashless TITO system). In such cashless embodiments, gaming device 104A may also include a "ticket-out" printer 126 for outputting a credit ticket when a "cash out" button is pressed. Cashless ticket systems are well known in the art and are used to generate and track unique bar-codes printed on tickets to allow players to avoid the use of bills and coins by loading credits using a ticket reader and cashing out credits using ticket-out printer 126 on gaming device 104A.

In certain embodiments, a player tracking card reader 144, a transceiver for wireless communication with a player's smartphone, a keypad 146, and/or an illuminated display 148 for reading, receiving, entering, and/or displaying player tracking information can be provided. In such embodiments, a game controller within gaming device 104A communicates with player tracking server system 110 to send and receive player tracking information.

Gaming device 104A may also include, in certain embodiments, a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but could also be incorporated into play of the base game, or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

In certain embodiments, there may also be one or more information panels 152 that may be, for example, a back-lit silkscreened glass panel with lettering to indicate general game information including, for example, a game denomination (e.g., $0.25 or $1), pay lines, pay tables, and/or various game related graphics. In some embodiments, information panels 152 may be implemented as an additional video display.

Gaming device 104A traditionally includes a handle 132 typically mounted to the side of main cabinet 116 that may be used to initiate game play.

Figure 2:
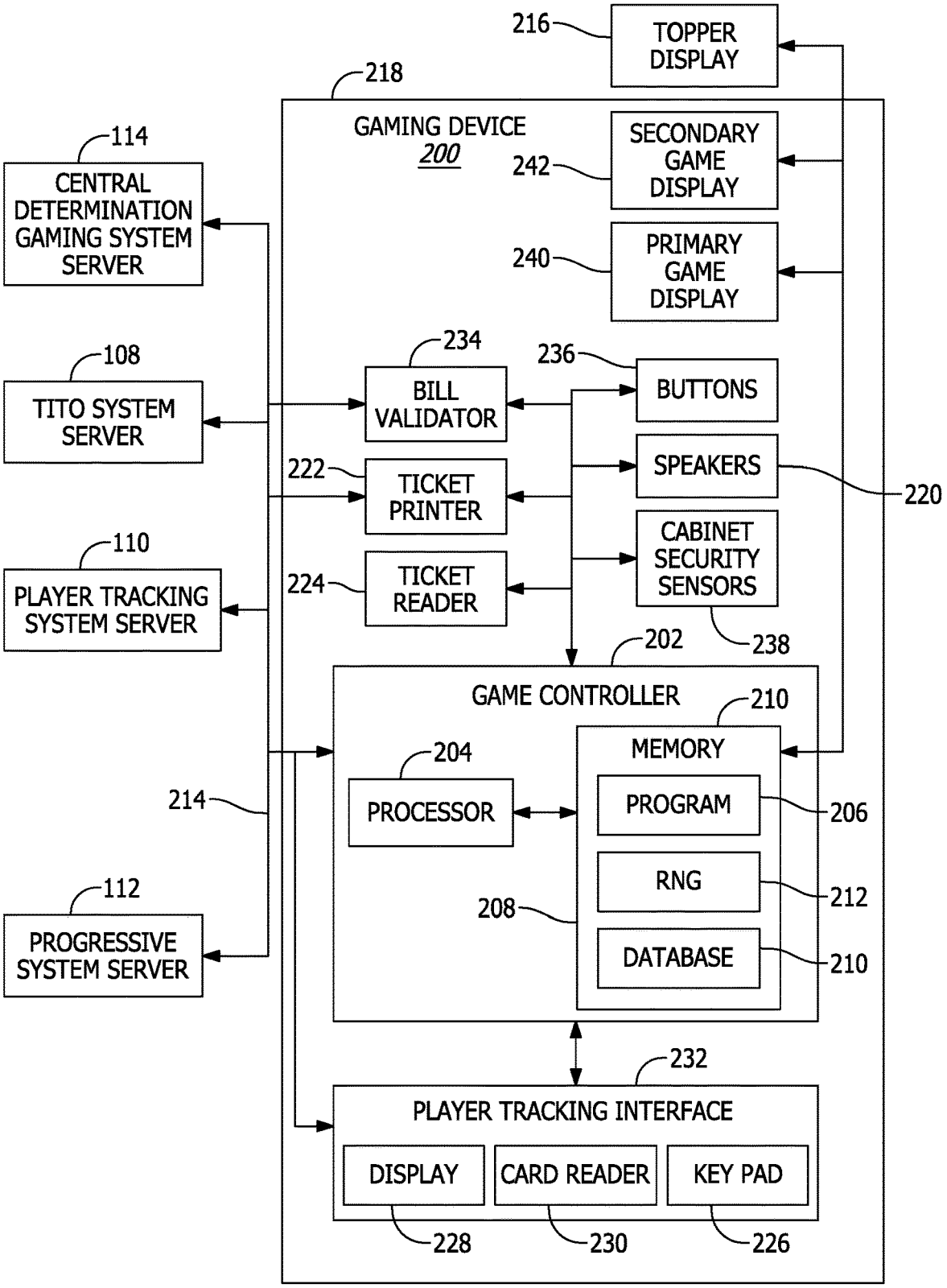
FIG. 2 is a block diagram of an exemplary gaming device.

Many or all of the above described components may be controlled by circuitry (e.g., a gaming controller) housed inside main cabinet 116 of gaming device 104A, the details of which are shown in FIG. 2.

Not all gaming devices suitable for implementing embodiments of the gaming systems, gaming devices, or methods described herein necessarily include top wheels, top boxes, information panels, cashless ticket systems, and/or player tracking systems. Further, some suitable gaming devices have only a single game display that includes only a mechanical set of reels and/or a video display, while others are designed, for example, for bar tables or table tops and have displays that face upwards.

Exemplary gaming device 104B shown in FIG. 1 is an Arc™ model gaming device manufactured by Aristcrat® Technologies, Inc. Where possible, reference numeral identifying similar features of gaming device 104A are also identified in gaming device 104B using the same reference numerals. Gaming device 104B, however, does not include physical reels 130 and instead shows game play and related game play functions on main display 128. An optional topper screen 140 may be included as a secondary game display for bonus play, to show game features or attraction activities while the game is not in play, or any other information or media desired by the game designer or operator. In some embodiments, topper screen 140 may also or alternatively be used to display progressive jackpot prizes available to a player during play of gaming device 104B.

Gaming device 104B includes main cabinet 116 having main door 117 that opens to provide access to the interior of gaming device 104B. Main door 117, or service door, is typically used by service personnel to refill ticket-out printer 126 and collect bills and tickets inserted into bill validator 124. Main door 117 may further be accessed to reset the machine, verify and/or upgrade the software, and for general maintenance operations.

Exemplary gaming device 104C shown in FIG. 1 is a Helix™ model gaming device manufactured by Aristocrat® Technologies, Inc. Gaming device 104C includes a main display 128A that is in a landscape orientation. Although not illustrated by the front view illustrated in FIG. 1, landscape display 128A has a curvature radius from top to bottom. In certain embodiments, display 128A is a flat panel display. Main display 128A is typically used for primary game play while a secondary display 128B is used for bonus game play, to show game features or attraction activities while the game is not in play, or any other information or media desired by the game designer or operator.

In addition, as shown best with respect to gaming device 104C, an access door (or "drop door") 119 may be included, such as, for example, to give access to a cashbox containing cash and/or tickets provided by a player, as described herein, to gaming device 104C. In certain embodiments, access door 119 is formed in main door 117; however, in other embodiments, main door 117 may simply function as access door 119. In addition, although access door 119 is only depicted with respect to gaming device 104C, it will be understood that gaming devices 104A and/or 104B may also include an access door 119.

Many different types of games, including mechanical slot games, video slot games, video poker, video black jack, video pachinko, keno, bingo, and lottery, may be provided with or implemented within gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, Class II, or Class III, etc.

FIG. 2 is a block diagram of an exemplary gaming device 200, or EGM, connected to various external systems, including TITO system server 108, player tracking system server 110, progressive system server 112, and casino management system server 114. All or parts of gaming device 200 may be embodied in game devices 104A-104X shown in FIG. 1. The games conducted on gaming device 200 are controlled by a game controller 202 that includes one or more processors 204 and a memory 208 coupled thereto. Games are represented by game software or a game program 206 stored on memory 208. Memory 208 includes one or more mass storage devices or media housed within gaming device 200. One or more databases 210 may be included in one or more databases 210 for use by game program 206. A random number generator (RNG) 212 is implemented in hardware and/or software and is used, in certain embodiments, to generate random numbers for use in operation of gaming device 200 to conduct game play and to ensure the game play outcomes are random and meet regulations for a game of chance.

Alternatively, a game instance, or round of play of the game, may be generated on a remote gaming device such as central determination gaming system server 106, shown in FIG. 1. The game instance is communicated to gaming device 200 via a network 214 and is then displayed on gaming device 200. Gaming device 200 executes game software to enable the game to be displayed on gaming device 200. In certain embodiments, game controller 202 executes video streaming software that enables the game to be displayed on gaming device 200. Game software may be loaded from memory 208, including, for example, a read only memory (ROM), or from central determination gaming system server 106 into memory 208. Memory 208 includes at least one section of ROM, random access memory (RAM), or other form of storage media that stores instructions for execution by processor 204.

Gaming device 200 includes a topper display 216. In an alternative embodiment, gaming device 200 includes another form of a top box such as, for example, a topper wheel, or other topper display that sits on top of main cabinet 218. Main cabinet 218 or topper display 216 may also house various other components that may be used to add features to a game being played on gaming device 200, including speakers 220, a ticket printer 222 that prints bar-coded tickets, a ticket reader 224 that reads bar-coded tickets, and a player tracking interface 232*a*. Player tracking interface 232*a* may include a keypad 226 for entering player tracking information, a player tracking display 228 for displaying player tracking information (e.g., an illuminated or video display), a card reader 230 for receiving data and/or communicating information to and from media or a device such as a smart phone enabling player tracking. Ticket printer 222 may be used to print tickets for TITO system server 108. Gaming device 200 may further include a bill validator 234, buttons 236 for player input, cabinet security sensors 238 to detect unauthorized opening of main cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered and time of play) for individual players so that an operator may reward players in a loyalty program. The player may use player tracking interface 232*a* to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by casino management system server 114.

Gaming devices, such as gaming devices 104A-104X and 200, are highly regulated to ensure fairness and, in many cases, gaming devices 104A-104X and 200 are operable to award monetary awards (e.g., typically dispensed in the form of a redeemable voucher). Therefore, to satisfy security and regulatory requirements in a gaming environment, hardware and software architectures are implemented in gaming devices 104A-104X and 200 that differ significantly from those of general-purpose computers. Adapting general purpose computers to function as gaming devices 200 is not simple or straightforward because (1) regulatory requirements for gaming devices, (2) harsh environments in which gaming devices operate, (3) security requirements, and (4) fault tolerance requirements. These differences require substantial engineering effort and often additional hardware.

When a player wishes to play gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances of the game. The credit balance is decreased by the amount of each wager and increased upon a win. The player can add additional credits to the balance at any time. The player may also optionally insert a loyalty club card into card reader 230. During the game, the player views the game outcome on game displays 240 and 242. Other game and prize information may also be displayed.

For each game instance, a player may make selections that may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using player-input buttons 236, primary game display 240, which may include a touch screen, or using another suitable device that enables a player to input information into gaming device 200.

During certain game events, gaming device 200 may display visual and auditory effects that can be perceived by the player. These effects add to the excitement of a game, which makes a player more likely to continue playing. Auditory effects include various sounds that are projected by speakers 220. Visual effects include flashing lights, strobing lights, or other patterns displayed from lights on gaming device 200 or from lights behind information panel 152, shown in FIG. 1.

When the player wishes to stop playing, he/she cashes out the credit balance (typically by pressing a cash out button to receive a ticket from ticket printer 222). The ticket may be "cashed-in" for money or inserted into another machine to establish a credit balance for play.

With reference now to FIGS. 3A-8, an exemplary hinge assembly 300 is described. Hinge assembly 300 may be coupled to and/or used with any of the electronic gaming devices 104A-104C described above. For example, hinge assembly 300 may couple access door 119 (and/or any other door, such as main door 117) to main cabinet 116. In addition, as described in detail below, hinge assembly 300 may permit access door 119 to open to an angle of approximately one-hundred-and-sixty degrees, such that an external surface of main cabinet 116 (which may include artwork and which is player-facing) is not damaged by access door 119 when it is opened.

Figure 3B:
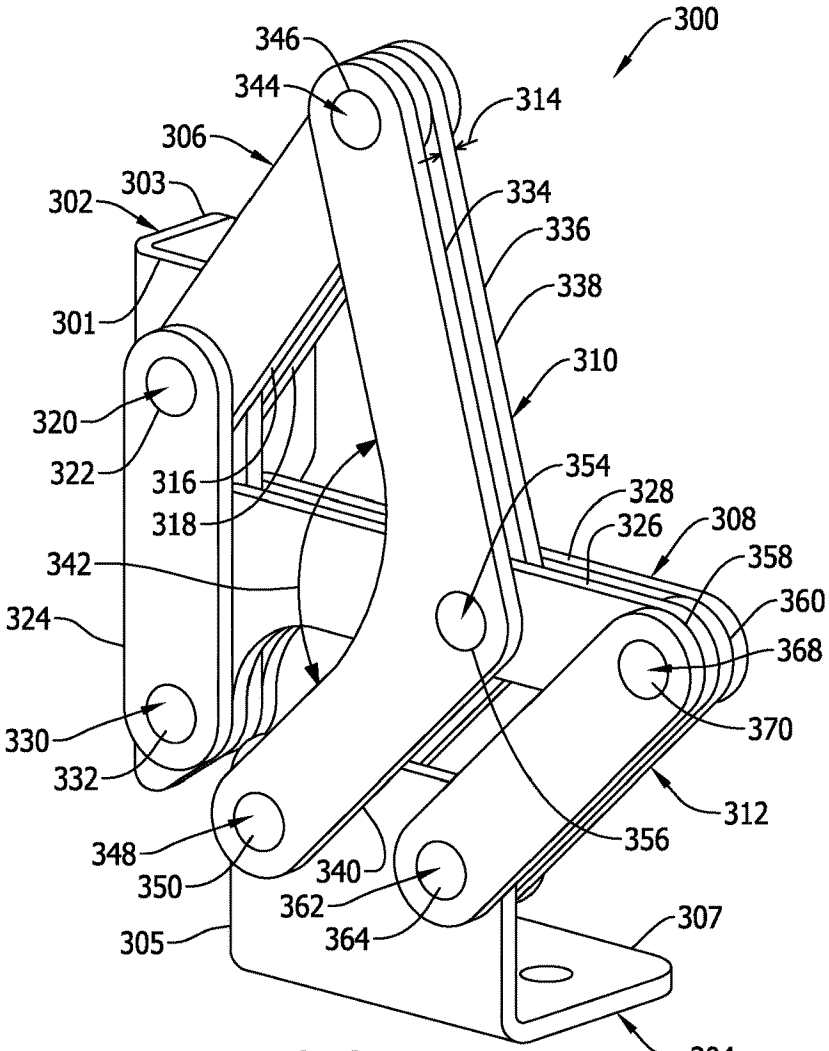
FIG. 3B is a second perspective view of the hinge assembly shown in FIG. 3A.
Figure 3A:
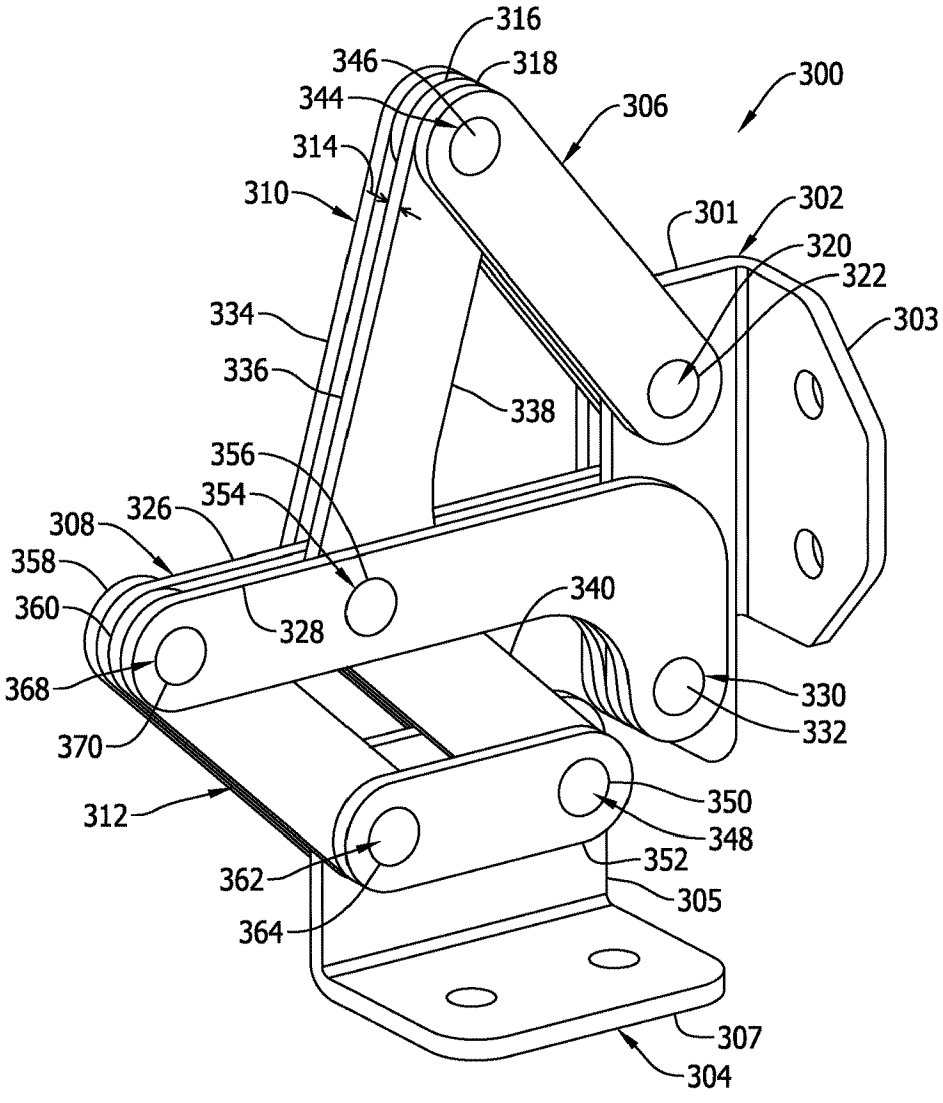
FIG. 3A is a first perspective view of an exemplary hinge assembly for use with an EGM shown in FIG. 1.

FIG. 3A is a first perspective view of hinge assembly 300, and FIG. 3B is a second perspective view of hinge assembly 300. Accordingly, and in general, hinge assembly 300 includes a plurality of interconnected pairs of links (or "link pairs") coupled between a first flange and a second flange. Each link pair includes an elongated member (or "link") coupled through at least one pivot joint to another substantially identical elongated member (or "link"). Link pairs are coupled or interconnected to one another at one or more pivot joints by interleaving, interlocking, and/or interdigitating the links of one link pair with the links of another link pair. Further, in the exemplary embodiment, each pivot joint includes a fastener, such as a rivet, arranged to rotatably couple link pairs, one to another, or, as described below, a link pair to a flange. The use of rivets to couple link pairs may reduce or eliminate lateral flex in hinge assembly 300, such that each of the link pairs are maintained in a stable relationship to one another. It will be appreciated, however, that other types of fasteners may be implemented in hinge assembly 300, such as, for example, and without limitation, one or more screws, one or more bolts, and the like. In addition, in some embodiments, one or more flattened or low profile rivets may be used, such as, for example, to make hinge assembly 300 more compact.

More particularly, a plurality of interconnected link pairs, such as a first link pair 306, a second link pair 308, a third link pair 310, and a fourth link pair 312, may be coupled between a first flange 302 and a second flange 304. In the exemplary embodiment, first flange 302 includes a first portion 301 and a second portion 303 extending orthogonally away from first portion 301. Similarly, second flange 304 includes a first portion 305 and a second portion 307 extending orthogonally away from first portion 305. In addition, first flange 302 is configured to be mechanically coupled, such as by one or more fasteners (e.g., one or more rivets, bolts, or screws) to access door 119, as described below, and second flange 304 is configured to be mechanically coupled, such as by one or more fasteners (e.g., one or more rivets, bolts, or screws) to main cabinet 116. Thus, hinge assembly 300 may be coupled, through flanges 302 and 304, between main cabinet 116 and an access door 119.

In the exemplary embodiment, link pairs 306-312 may be interdigitated with one another (and/or with a flange 302 or 304) to achieve an interconnected arrangement of link pairs 306-312. To this end, the links of each of link pairs 306-312 may be of substantially identical thickness. For convenience, the thickness of a link is referred to herein as a "link thickness," such as the exemplary link thickness 314 shown at FIGS. 3A and 3B. To accommodate interdigitation between a link pair 306-312 and a flange 302 and/or 304, the thicknesses of flanges 302 and 304 may also be the link thickness. In addition, each of the two links of a link pair 306-312 may be spaced apart from one another by the link thickness, such that a link of one link pair 306-312 may be interdigitated with the two links of another link pair 306-312 and/or with a flange 302 and/or 304.

In the example shown, first link pair 306 includes a first elongated link 316 and a second, substantially identical, elongated link 318. First elongated link 316 is spaced apart from second elongated link 318 by the link thickness, and first link pair 306 is interdigitated with and secured on first portion 301 of first flange 302 at a first pivot joint 320. Specifically, a first rivet 322 is inserted through first link pair 306 and first flange 302 at first pivot joint 320 to rotatably secure first link pair 306 on first flange 302. In some embodiments, a mounting bracket 324 may be coupled against first elongated link 316 of first link pair 306 to further secure first link pair 306 on first flange 302.

Likewise, second link pair 308 includes a first elongated link 326 and a second, substantially identical, elongated link 328. First elongated link 326 and second elongated link 328 are substantially "L-shaped" and are spaced apart from one another by the link thickness. In addition, second link pair 308 is interdigitated with first portion 301 of first flange 302 at a second pivot joint 330. Specifically, a second rivet 332 is inserted through second link pair 308 and first flange 302 at second pivot joint 330 to rotatably secure second link pair 308 on first flange 302. As above, and in some embodiments, mounting bracket 324 may be coupled against first elongated link 326 of second link pair 308 to further secure second link pair 308 on first flange 302.

Continuing, third link pair 310 includes a first elongated link 334 and a second, substantially identical, elongated link 336. First elongated link 334 and second elongated link 336 are bent, such that, on the whole, third link pair 310 includes a first portion 338 and a second portion 340 that meets first portion 338 at an angle 342, such as at an angle of approximately one-hundred-and-eighteen degrees. A variety of other angles 342 are contemplated, however, such as, for example, and without limitation, any obtuse angle.

In the exemplary embodiment, elongated links 336 and 338 of third link pair 310 are spaced apart from one another by the link thickness and are interdigitated with elongated links 316 and 318 of first link pair 306 at a third pivot joint 344. Specifically, a third rivet 346 is inserted through first link pair 306 and third link pair 310 at third pivot joint 344 to rotatably couple first link pair 306 and third link pair 310.

Third link pair 310 is also interdigitated with and secured on first portion 305 of second flange 304 at a fourth pivot joint 348. Specifically, a fourth rivet 350 is inserted through third link pair 310 and second flange 304 at fourth pivot joint 348 to rotatably secure third link pair 310 on second flange 304. In some embodiments, a mounting bracket 352 may be coupled against second elongated link 336 of third link pair 310 to further secure third link pair 310 on second flange 304.

In addition, third link pair 310 is interdigitated with and coupled to second link pair 308 at a fifth pivot joint 354. Specifically, a fifth rivet 356 is inserted through third link pair 310 and second link pair 308 at fifth pivot joint 354 to rotatably couple third link pair 310 and second link pair 308. As shown, fifth pivot joint 354 is located substantially at the junction of first portion 338 and second portion 340 of third link pair 310. In other words, fifth pivot joint 354 is located on third link pair 310 at the bend formed in third link pair 310.

Fourth link pair 312 is, in addition, interdigitated with and coupled between first portion 305 of second flange 304 and second link pair 308. To this end, fourth link pair 312 includes a first elongated link 358 and a second, substantially identical, elongated link 360, where, as described with respect to the other link pairs 306-310, first elongated link 358 and second elongated link 360 are spaced apart from one another by the link thickness.

In the exemplary embodiment, fourth link pair 312 is interdigitated with and secured on second flange 304 at a sixth pivot joint 362. Specifically, a sixth rivet 364 is inserted through fourth link pair 312 and second flange 304 to rotatably secure fourth link pair 312 on second flange 304. In some embodiments, mounting bracket 352 may be coupled against second elongated link 360 of fourth link pair 312 to further secure fourth link pair 312 on second flange 304. Fourth link pair 312 is also interdigitated with and coupled to second link pair 308 at a seventh pivot joint 368. Specifically, a seventh rivet 370 is inserted through fourth link pair 312 and second link pair 308 at seventh pivot joint 368 to rotatably couple fourth link pair 312 and second link pair 308 at seventh pivot joint 368.

Thus, hinge assembly 300 includes a plurality of interconnected link pairs coupled between a first flange and a second flange. Each link pair includes a plurality of substantially identical links, and link pairs are interconnected at one or more pivot joints by interleaving, interlocking, and/or interdigitating the links of one link pair with the links of another link pair, and, where a link pair is coupled to a flange, by interdigitating the links of the link pair with a portion of the flange. Further, in the exemplary embodiment, each pivot joint includes a fastener, such as a rivet, arranged to rotatably couple link pairs, one to another, as well as link pairs, as described above, to a flange.

Figure 4A:
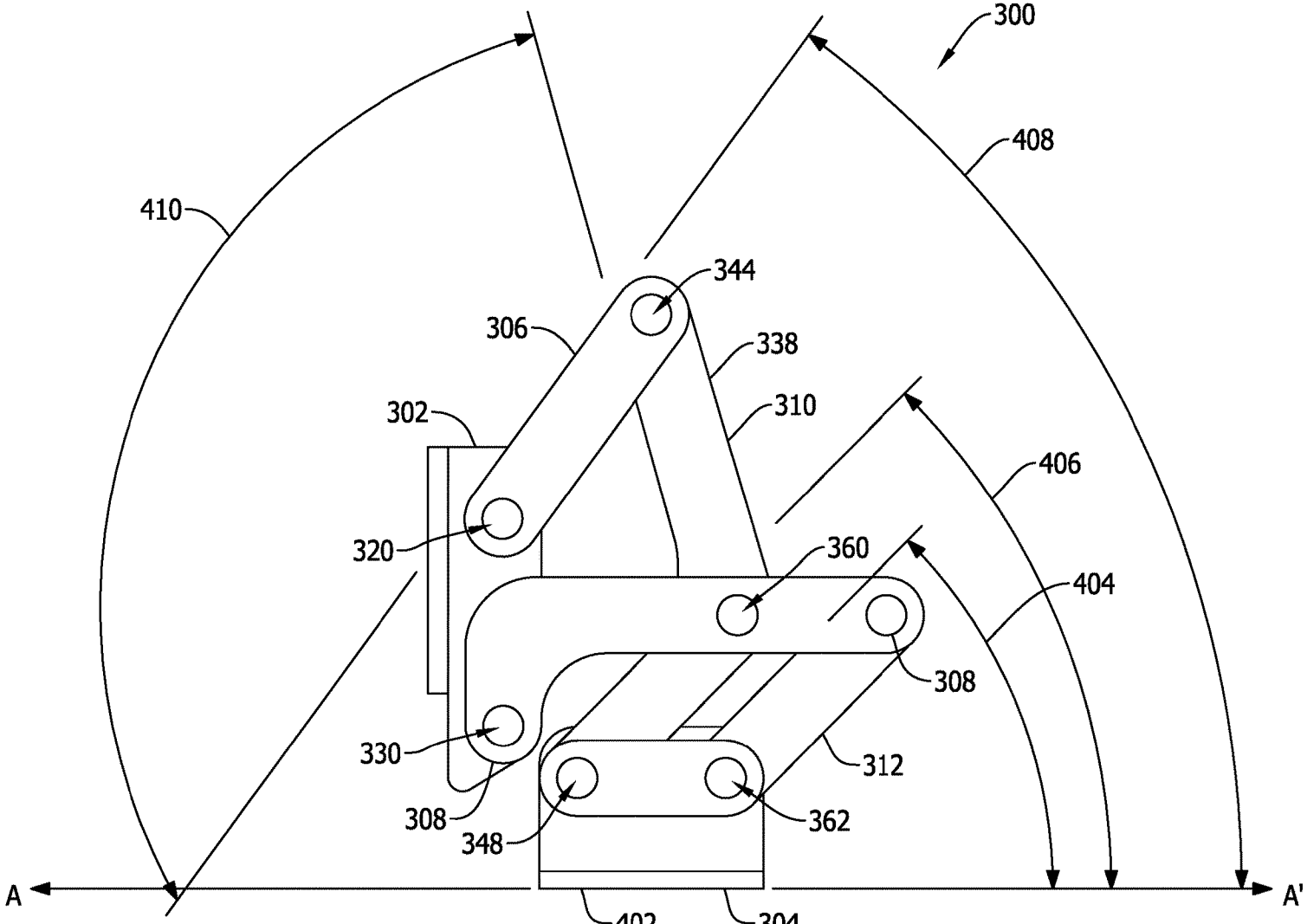
FIG. 4A is a side view of the hinge assembly shown in FIGS. 3A and 3B, in which the hinge assembly is in a closed position.
Figure 4B:
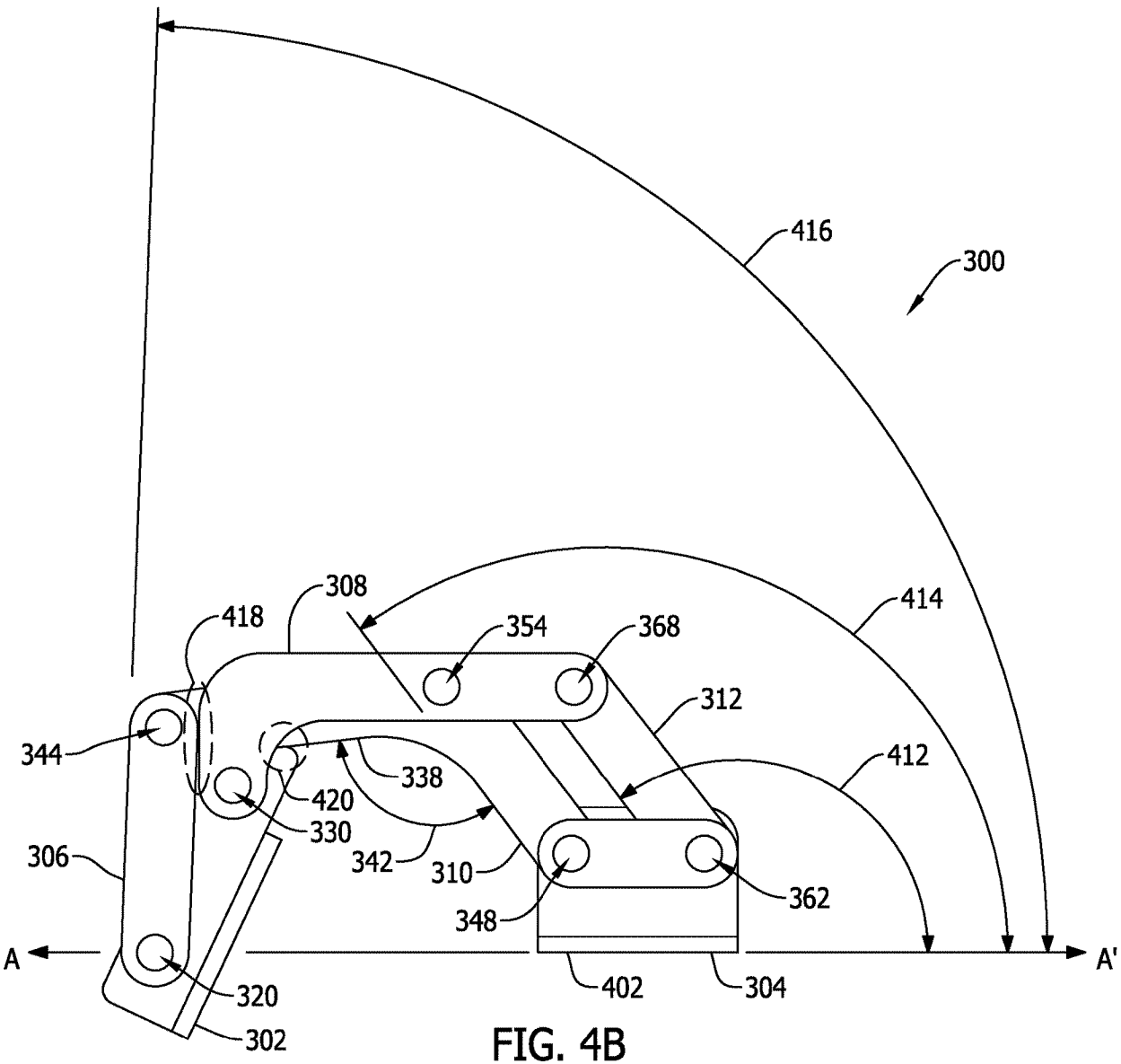
FIG. 4B is a side view of the hinge assembly shown in FIGS. 3A and 3B, in which the hinge assembly is in an open position.

As described briefly above, hinge assembly 300 is expandable and collapsible between a closed position and an open position, such as, for example, to accommodate opening and closing of access door 119 coupled by hinge assembly 300 to main cabinet 116 of any of gaming devices 104A-104C. FIGS. 4A and 4B depict hinge assembly 300 in a closed, and open, position, respectively. Specifically, FIG.

4A is a side view of hinge assembly 300 (shown in FIGS. 3A and 3B), in which hinge assembly 300 is in a closed position. Similarly, FIG. 4B is a side view of hinge assembly 300, in which hinge assembly 300 is in an open position.

Accordingly, in a closed position, and as shown with specific reference to FIG. 4A, a plurality of angles may be formed between various link pairs 306-312 of hinge assembly 300 and a line A-A' defined with respect to a base 402 of second flange 304. Although specific angles are provided below, it will be appreciated that these angles are merely exemplary, and that other angles, or ranges of angles, may be implemented as well.

In the exemplary embodiment, and in a closed position, an angle 404 between the line A-A' and fourth link pair 312 is approximately forty-five degrees. However, in other embodiments, angle 404 may range from five degrees to sixty degrees. Likewise, an angle 406 between the line A-A' and second portion 340 of third link pair 310 is approximately forty-five degrees. However, in other embodiments, angle 406 may range from five degrees to seventy-five degrees. In addition, an angle 408 between the line A-A' and first link pair 306 is approximately fifty-four degrees. However, in other embodiments, angle 408 may range from zero degrees to ninety degrees. Further, in the exemplary embodiment, an angle 410 between first portion 338 of third link pair 310 and first link pair 306 is approximately three-hundred-and-eight degrees. However, in other embodiments, angle 410 may range from one-hundred-and-ninety-five degrees to three-hundred-and-fifty-five degrees.

Similarly, in an open position, and as shown with specific reference to FIG. 4B, a plurality of angles may be formed between various link pairs 306-312 of hinge assembly 300 and a line A-A' defined with respect to base 402 of second flange 304. As above, although specific angles are provided below, it will be appreciated that these angles are merely exemplary, and that other angles, or ranges of angles, may be implemented as well.

Therefore, in the exemplary embodiment, and in an open position, an angle 412 between the line A-A' and fourth link pair 312 is approximately one-hundred-and-twenty-seven degrees. However, in other embodiments, angle 412 may range from sixty-five degrees to one-hundred-and-thirty-five degrees. Likewise, an angle 414 between the line A-A' and second portion 340 of third link pair 310 is approximately one-hundred-and-twenty-seven degrees. However, in other embodiments, angle 414 may range from fifty-five degrees to one-hundred-and-forty-five degrees. In addition, an angle 416 between the line A-A' and first link pair 306 is approximately eighty-seven degrees. However, in other embodiments, angle 416 may range from forty-five degrees to one-hundred-and-forty-five degrees.

During operation, and with continuing reference to FIG. 4A, hinge assembly 300 may expand from a closed position into an open position until second link pair 308 makes contact with first link pair 306, such as, for example, over a contact region 418, as shown. Specifically, as hinge assembly 300 articulates and expands, second link pair 308 may ultimately come into contact with first link pair 306 at contact region 418, at which point hinge assembly 300 may be restrained or prevented from further articulation and expansion as second link pair 308 butts against first link pair 306. At the same time, third link pair 310 may butt against or come to rest upon a contact region 420 of first flange 302. As this occurs, hinge assembly 300 may be further restrained or prevented from additional articulation and expansion by surface contact between third link pair 310 and first flange 302. Thus, a working range of hinge assembly 300 may be limited (e.g., self-limited) by surface contact between several components of hinge assembly 300, and, as described below, the self-limiting working range of hinge assembly 300 may prevent over-rotation of an access door coupled to hinge assembly 300. Specifically, hinge assembly 300 may prevent rotation of an access door into potentially damaging contact with an external surface of an electronic gaming device 104A-104C.

Figure 5B:
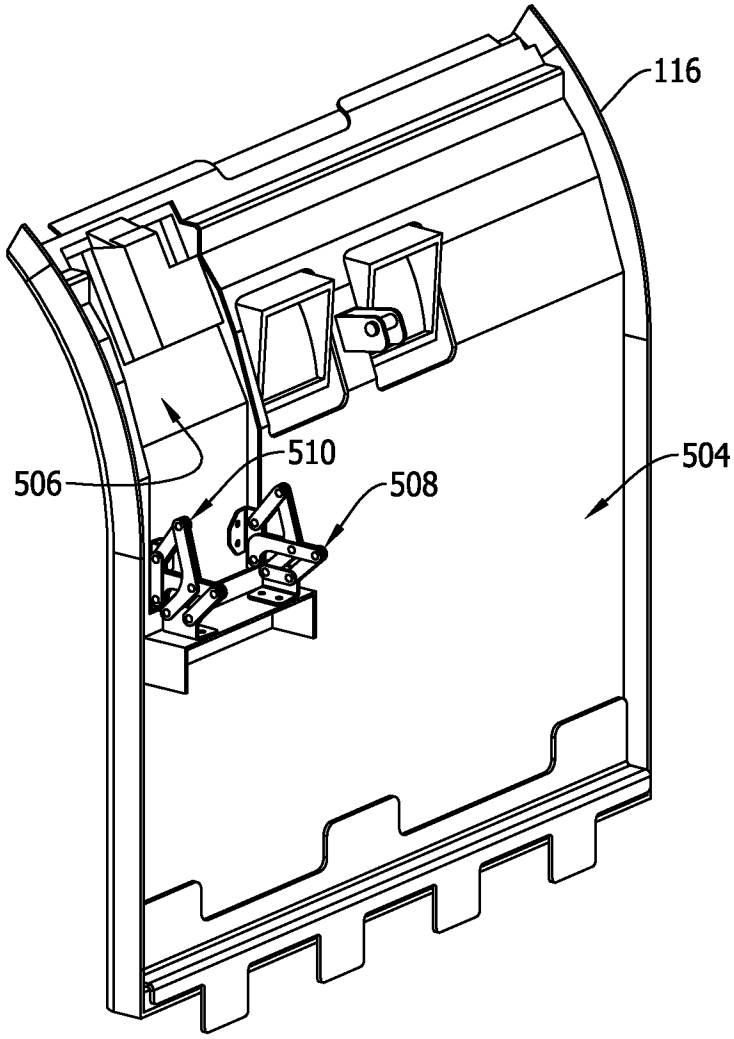
FIG. 5B is a perspective view of an internal surface of an exemplary gaming machine cabinet of an EGM shown in FIG. 1, in which an access door is in a closed position.
Figure 5A:
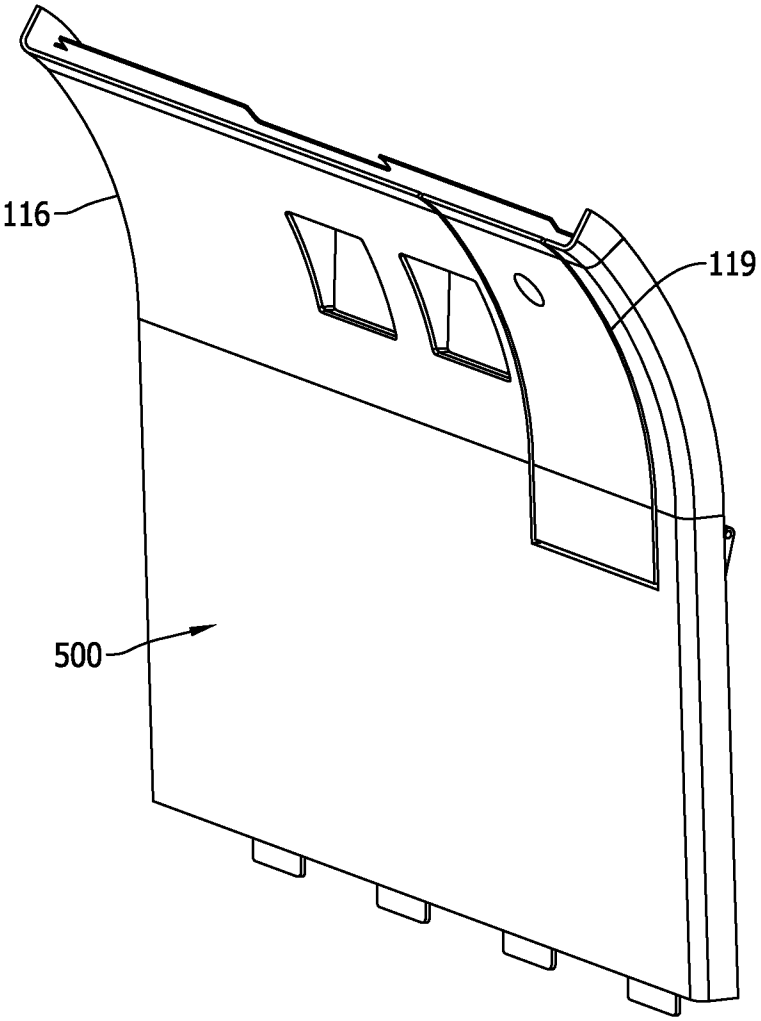
FIG. 5A is a perspective view of an external surface of an exemplary gaming machine cabinet of an EGM shown in FIG. 1, in which an access door is in a closed position.

With reference now to FIGS. 5A-7B, operation of a plurality of hinge assemblies (such as hinge assembly 300) are described in conjunction with main cabinet 116 of an electronic gaming device 104A-104C. Specifically, FIG. 5A is a perspective view of an external surface 500 main cabinet 116, in which access door 119, a first hinge assembly 508, and a second hinge assembly 510 are in a closed position. Similarly, FIG. 5B is a perspective view of an internal surface 504 of main cabinet 116, in which access door 119, first hinge assembly 508, and second hinge assembly 510 are in a closed position.

Accordingly, as shown with primary reference to FIG. 5B, first hinge assembly 508 and second hinge assembly 510 are coupled between an internal surface 506 of access door 119 and internal surface 504 of main cabinet 116. Thus, in a closed position, hinge assemblies 508 and 510 are mounted internally within main cabinet 116, such that hinge assemblies 508 and 510 are inaccessible outside of an electronic gaming device 104A-104C. As such, hinge assemblies 508 and 510 are protected from tampering, oxidation (e.g., rust), and accumulated paint and other debris.

Figure 6B:
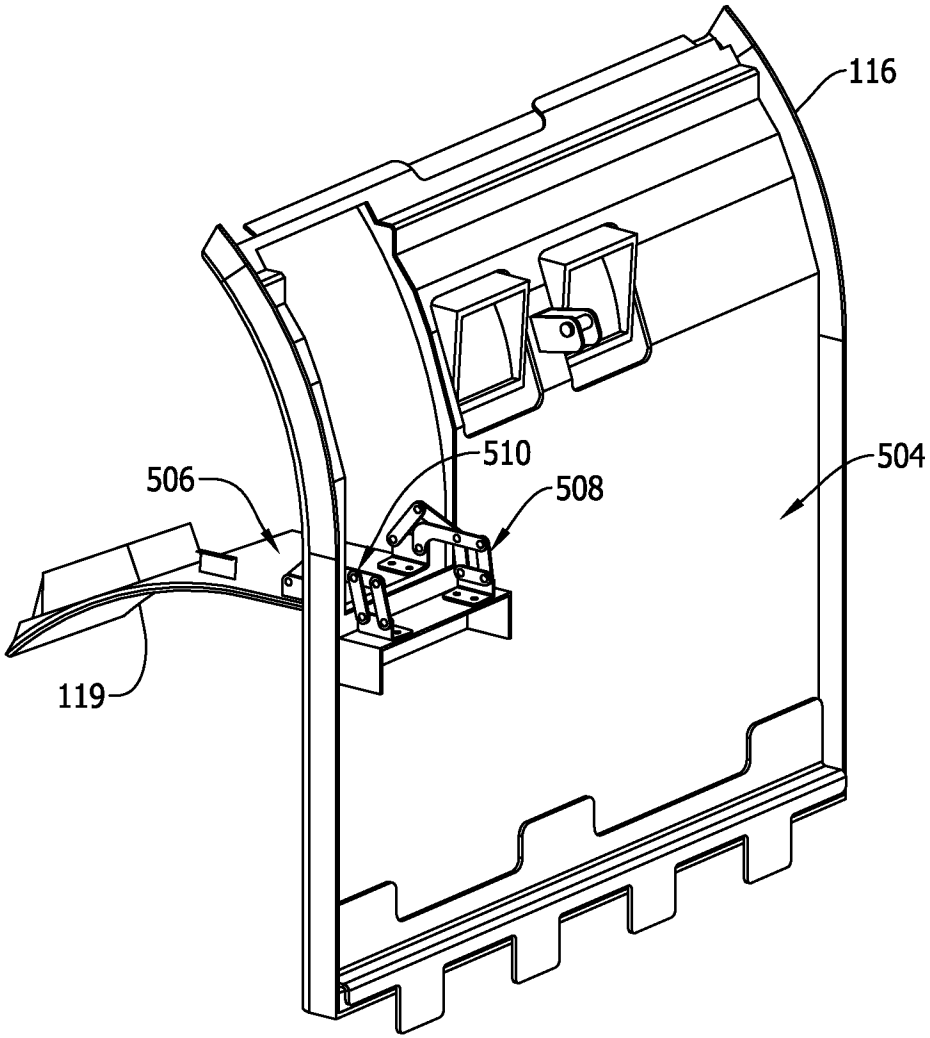
FIG. 6B is a perspective view of an internal surface of an exemplary gaming machine cabinet of an EGM shown in FIG. 1, in which an access door is in a partially open position.
Figure 6A:
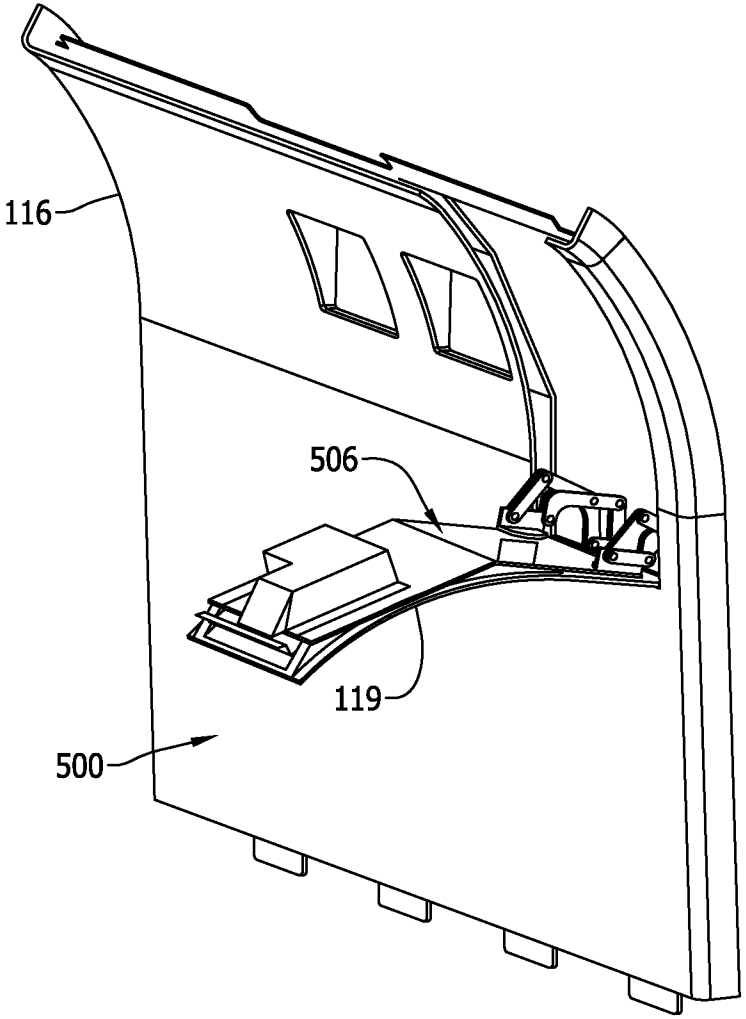
FIG. 6A is a perspective view of an external surface of an exemplary gaming machine cabinet of an EGM shown in FIG. 1, in which an access door is in a partially open position.

To open access door 119, a gaming machine technician may unlock access door 119, such as by way of a locking mechanism (not shown) disposed within access door 119 that is arranged to secure access door 119 is a closed position until access door 119 is unlocked (e.g., with a key) by the gaming machine technician. Once unlocked, access door 119 may drop out of and away from main cabinet 116, as shown with reference to FIGS. 6A-7B. Specifically, FIG. 6A is a perspective view of external surface 500 of main cabinet 116 in which access door 119 and hinge assemblies 508 and 510 are in a partially open position. Likewise, FIG. 6B is a perspective view of internal surface 504 of main cabinet 116, in which access door 119 and hinge assemblies 508 and 510 are in a partially open position. As shown, hinge assemblies 508 and 510 expand to allow access door 119 to drop out of and away from main cabinet 116 towards external surface 500 of main cabinet 116.

As described herein, however, access door 119 is prevented from rotating through a full one-hundred-and-eighty degrees towards external surface 500 of main cabinet 116. Rather, and as shown with reference to FIGS. 7A and 7B, both of which show access door 119 and hinge assemblies 508 and 510 in a fully open position, an angle 702 formed between external surface 500 of main cabinet 116 and internal surface 506 of access door 119 is less than one-hundred-and-eighty degrees. Specifically, and in the exemplary embodiment, angle 702 is approximately one-hundred-and-sixty degrees. However, it will be appreciated that any angle less than one-hundred-and-eighty degrees may be implemented, provided, for example, that access door 119 drops far enough out of the way to accommodate access, by a gaming machine technician, to a cash box (not shown) disposed within main cabinet 116 and accessible via access door 119.

Figure 7B:
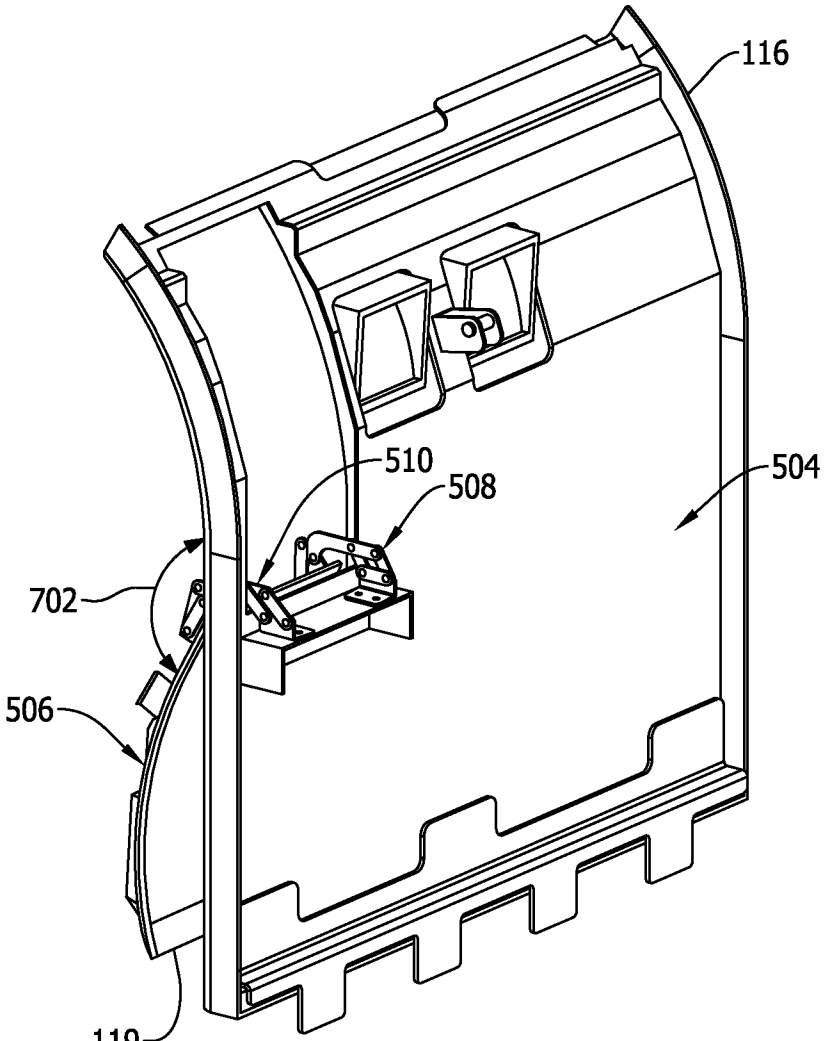
FIG. 7B is a perspective view of an internal surface of an exemplary gaming machine cabinet of an EGM shown in FIG. 1, in which an access door is in an open position.
Figure 7A:
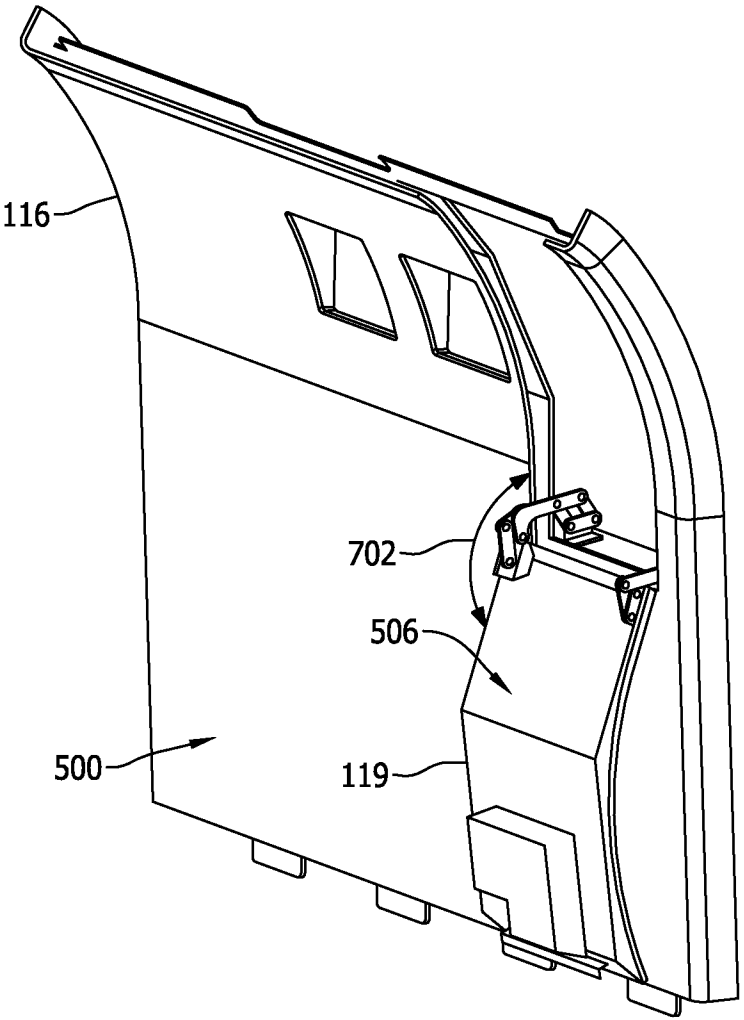
FIG. 7A is a perspective view of an external surface of an exemplary gaming machine cabinet of an EGM shown in FIG. 1, in which an access door is in an open position.
Figure 8:
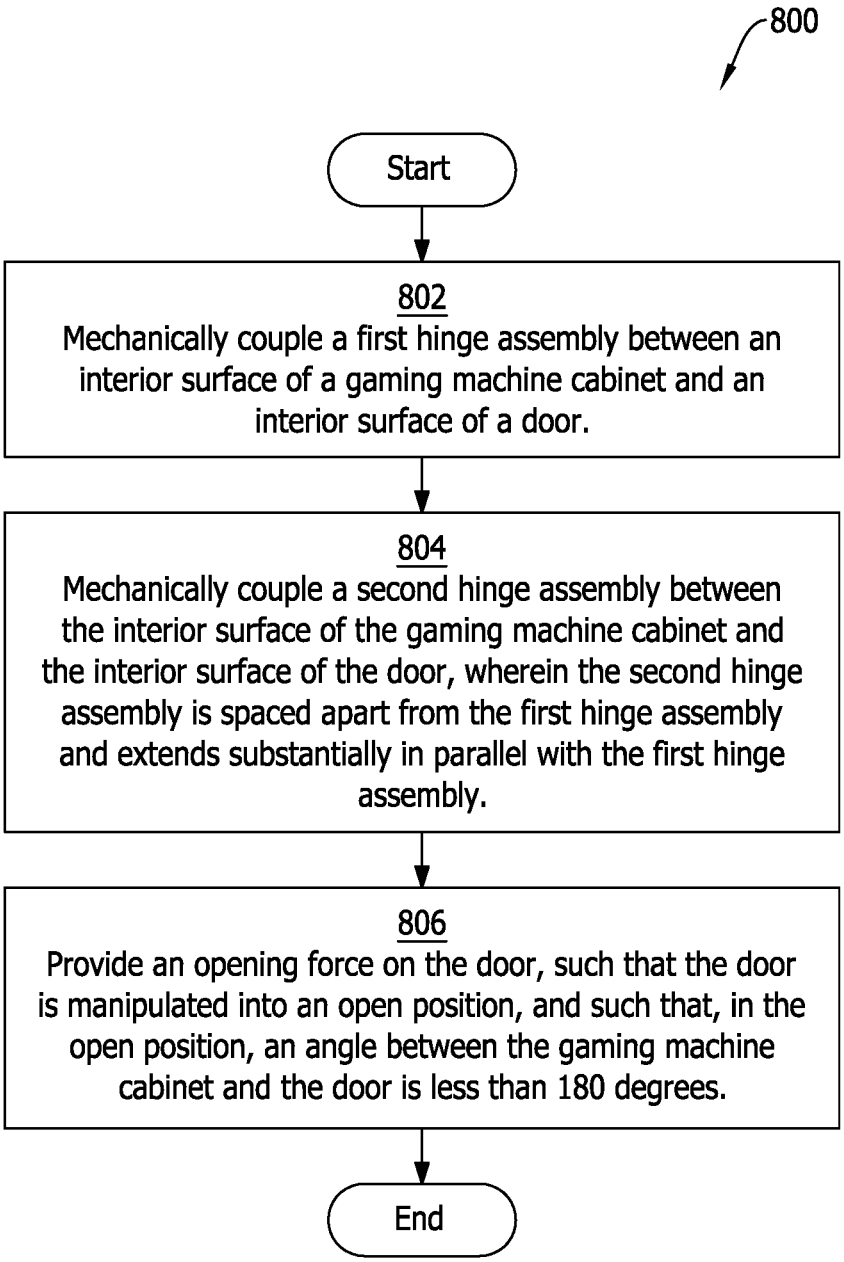
FIG. 8 is a flowchart illustrating an exemplary process for securing an access door on a gaming machine cabinet of the gaming machine shown in FIG. 1.

FIG. 8 is a flowchart illustrating an exemplary process 800 for securing access door 119 on main cabinet 116 of an electronic gaming device 104A-104C. In the exemplary embodiment, and as described herein, a technician may mechanically couple first hinge assembly 508 between internal surface 506 of access door 119 and internal surface 504 of main cabinet 116 (step 802). Similarly, a technician may mechanically couple second hinge assembly 510 between internal surface 506 of access door 119 and internal surface 504 of main cabinet 116, such that first hinge assembly 508 is spaced apart from second hinge assembly 510 and extends substantially in parallel with first hinge assembly 510 (step 804). Having coupled access door 119 to main cabinet 116, and during operation, the technician may provide an opening force on access door 119, such that hinge assemblies 508 and 510 and access door 119 are manipulated from a closed position (e.g., as shown at FIGS. 5A and 5B) into an open position (e.g., as shown at FIGS. 7A and 7B), and such that angle 702 between main cabinet 116 and access door 119 is less than one-hundred-and-eighty degrees (step 806). For example, in one embodiment, angle 702 is approximately one-hundred-and-sixty degrees, which may be suitable to prevent contact between access door 119 and external surface 500 of main cabinet 116.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As indicated above, the process may be embodied in computer software. The computer software could be supplied in a number of ways, for example on a tangible, non-transitory, computer readable storage medium, such as on any nonvolatile memory device (e.g. an EEPROM). Further, different parts of the computer software can be executed by different devices, such as, for example, in a client-server relationship. Persons skilled in the art will appreciate that computer software provides a series of instructions executable by the processor.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming machine, comprising:

a main cabinet enclosing at least one inner component of the electronic gaming machine;

a door providing access to the at least one inner component; and at least one hinge assembly securing the door to the main cabinet, wherein when the at least one hinge assembly is in a closed position the at least one hinge assembly is mounted internally within the main cabinet to prevent tampering of the at least one inner component, the at least one hinge assembly comprising:

a first flange coupled to an internal surface of the door;

a second flange coupled to an internal surface of the main cabinet;

a first link pair coupled to and extending from the first flange at a first pivot joint;

a second link pair coupled to and extending from the first flange at a second pivot joint; and a third link pair coupled to the first link pair at a third pivot joint, the third link pair further coupled to the second flange at a fourth pivot joint, the third link pair further coupled to the second link pair at a fifth pivot joint.

2. The electronic gaming machine of claim 1, wherein the at least one hinge assembly further comprises a first contact region, wherein the first link pair comes into contact with the second link pair, preventing over-rotation of the door such that the door does not come into contact with an external surface of the electronic gaming machine.

3. The electronic gaming machine of claim 1, wherein the at least one hinge assembly further comprises a second contact region, wherein the third link pair comes into contact with the first flange, preventing contact of the door with an external surface of the electronic gaming machine.

4. The electronic gaming machine of claim 1, wherein the first flange comprises a first portion and a second portion, the second portion extending orthogonally away from the first portion and wherein the second flange comprises a first portion and a second portion, the second portion extending orthogonally away from the first portion.

5. The electronic gaming machine of claim 1, wherein the at least one hinge assembly further comprises a fourth link pair coupled to the second flange at a sixth pivot joint, the fourth link pair further coupled to the second link pair at a seventh pivot joint.

6. The electronic gaming machine of claim 1, wherein the second link pair comprises a first end, a second end, and a curved body disposed therebetween.

7. The electronic gaming machine of claim 1, wherein the second link pair is L-shaped.

8. The electronic gaming machine of claim 1, wherein the third link pair further comprises a first portion that extends between the third pivot joint and the fifth pivot joint, a second portion that extends between the fourth pivot joint and the fifth pivot joint, and wherein the first portion meets the second portion at an angle that is greater than ninety degrees.

9. The electronic gaming machine of claim 1, wherein the at least one hinge assembly is arranged to expand from the closed position into an open position, wherein, in the open position, an angle between the main cabinet and the door is less than one-hundred-and-eighty degrees.

10. A hinge assembly for securing a door on a gaming machine cabinet enclosing at least one inner component, the hinge assembly comprising:

a first flange coupled to an internal surface of the door;

a second flange coupled to an internal surface of the gaming machine cabinet;

a first link pair coupled to and extending from the first flange at a first pivot joint;

a second link pair coupled to and extending from the first flange at a second pivot joint; and a third link pair coupled to the first link pair at a third pivot joint, the third link pair further coupled to the second flange at a fourth pivot joint, the third link pair further coupled to the second link pair at a fifth pivot joint, wherein when the hinge assembly is in a closed position the hinge assembly is mounted internally within the gaming machine cabinet to prevent tampering of the at least one inner component.

11. The hinge assembly of claim 10, wherein the hinge assembly further comprises a first contact region, wherein the first link pair comes into contact with the second link pair, preventing over-rotation of the door such that the door does not come into contact with an external surface of the gaming machine cabinet.

12. The hinge assembly of claim 10, wherein the hinge assembly further comprises a second contact region, wherein the third link pair comes into contact with the first flange, preventing contact of the door with an external surface of the gaming machine cabinet.

13. The hinge assembly of claim 10, wherein the first flange comprises a first portion and a second portion, the second portion extending orthogonally away from the first portion and wherein the second flange comprises a first portion and a second portion, the second portion extending orthogonally away from the first portion.

14. The hinge assembly of claim 10, wherein the hinge assembly further comprises a fourth link pair coupled to the second flange at a sixth pivot joint, the fourth link pair further coupled to the second link pair at a seventh pivot joint.

15. The hinge assembly of claim 10, wherein the second link pair comprises a first end, a second end, and a curved body disposed therebetween.

16. The hinge assembly of claim 10, wherein the second link pair is L-shaped.

17. The hinge assembly of claim 10, wherein the third link pair further comprises a first portion that extends between the third pivot joint and the fifth pivot joint, a second portion that extends between the fourth pivot joint and the fifth pivot joint, and wherein the first portion meets the second portion at an angle that is greater than ninety degrees.

18. The hinge assembly of claim 10, wherein the hinge assembly is arranged to expand from the closed position into an open position, wherein, in the open position, an angle between the gaming machine cabinet and the door is less than one-hundred-and-eighty degrees.

19. A method of securing a door to a gaming machine cabinet enclosing at least one inner component, the method comprising:

coupling a first hinge assembly between an interior surface of the gaming machine cabinet and an interior surface of the door; and coupling a second hinge assembly between the interior surface of the gaming machine cabinet and the interior surface of the door, wherein when the first and second hinge assemblies are in a closed position the first and second hinge assemblies are mounted internally within the gaming machine cabinet to prevent tampering of the at least one inner component, wherein each of the first and second hinge assemblies comprise:

a first flange coupled to the interior surface of the door;

a second flange coupled to the interior surface of the gaming machine cabinet;

a first link pair coupled to and extending from the first flange at a first pivot joint;

a second link pair coupled to and extending from the first flange at a second pivot joint; and a third link pair coupled to the first link pair at a third pivot joint, the third link pair further coupled to the second flange at a fourth pivot joint, the third link pair further coupled to the second link pair at a fifth pivot joint.

20. The method of claim 19, further comprising providing an opening force on the door, such that the door is manipulated into an open position, and such that, in the open position, an angle between the gaming machine cabinet and the interior surface of the door is less than one-hundred-and-eighty degrees such that the door does not come into contact with an external surface of the gaming machine cabinet.

* * * * *